US005191737A

United States Patent [19]

Snoddy

[11] Patent Number: 5,191,737

[45] Date of Patent: Mar. 9, 1993

[54] HOLLOW GRINDING FIXTURE

[76] Inventor: Lowell G. Snoddy, 419 Warner St., N.W., Huntsville, Ala. 35805

[21] Appl. No.: 570,889

[22] Filed: Aug. 22, 1990

[51] Int. Cl.[5] ..... B24B 3/36

[52] U.S. Cl. ..... 51/218 R; 511/102

[58] Field of Search ..... 51/216 R, 217 R, 218 R, 51/238 T, 102

[56] References Cited

U.S. PATENT DOCUMENTS

| | | | |
|---|---|---|---|
| 1,317,753 | 10/1919 | Braden | 51/102 |
| 2,579,680 | 12/1951 | Leighton | 51/102 |
| 3,032,934 | 5/1962 | Johnsa | 51/218 R |
| 3,574,268 | 4/1971 | Buse | 51/218 R |
| 4,819,384 | 4/1989 | Clark | 51/218 R |

*Primary Examiner*—Roscoe V. Parker
*Attorney, Agent, or Firm*—Phillips & Beumer

[57] ABSTRACT

A fixture for securely holding a member such as a knife against a grinding element such as a grinding wheel during a grinding operation. The fixture includes a blank (knife) support assembly rigidly secured to the upper plate which is slidably supported on a lower plate which is rigidly attached to the grinding device. An adjusting mechanism is interconnected between the upper and lower plate for the slidable movement of the upper plate on the lower plate to retain the blank (knife) support assembly, and thus the knife edge, against the grinding device during the grinding operation.

12 Claims, 3 Drawing Sheets

HOLLOW GRINDING FIXTURE

FIELD OF THE INVENTION

The present invention is generally directed to a fixture for retention of a blade or the like against a grinding member during a grinding operation. The invention is more directly related to such a fixture which is adjustable to maintain a predetermined pressure between the grinding member and a blank (blade) for hollow grinding thereof.

BACKGROUND OF THE INVENTION

In a typical process of making a "hand made" knife, the knife maker generally holds the knife blank by hand against a rotating grinding wheel and grinds away the required amount of metal to hone the edge to the desired sharpness. During the process, the blank is moved normally across the edge of the grinding wheel while it is manually held against the grinding wheel by the operator. Not only is such an operation time consuming, but it also usually results in a knife having a non-uniform blade edge.

To overcome such deficiencies, applicant has provided a fixture which is attachable to a grinder or the like which holds the blade securely against the grinding wheel while permitting the operator to move the knife blank back and forth across the surface of the grinding wheel to provide for uniform hollow grinding of the edge to a predetermined thickness in a rapid and facile manner.

SUMMARY OF THE INVENTION

This invention relates to a fixture for adjustably retaining the edge of a knife or the like against a grinding device, such as a grinding belt or wheel, while hollow grinding the edge of the knife or the like.

It is an object of the present invention, therefore, to provide a fixture which may be used with a grinding device to assist in the hollow grinding of a blank of material to produce a hollow ground knife edge thereon.

It is another object of the present invention to provide such a fixture with adjusting means to permit the fixture to hold and retain the blank against the grinding device with a predetermined pressure during the hollow grinding operation.

It is still a further object of the present invention to provide such a fixture with a hardened wear surface against which the blank or workpiece engages during the hollow grinding operation.

It is still yet another object of the present invention to provide such a fixture which is adaptable for use with various types of bench grinders having circular grinding wheels, with belt grinders, and with drum sanders.

These and other objects of the present invention will become more readily apparent from the following detailed description taken in conjunction with the accompanying drawings.

DESCRIPTION OF THE PREFERRED EMBODIMENT

Figure 1:
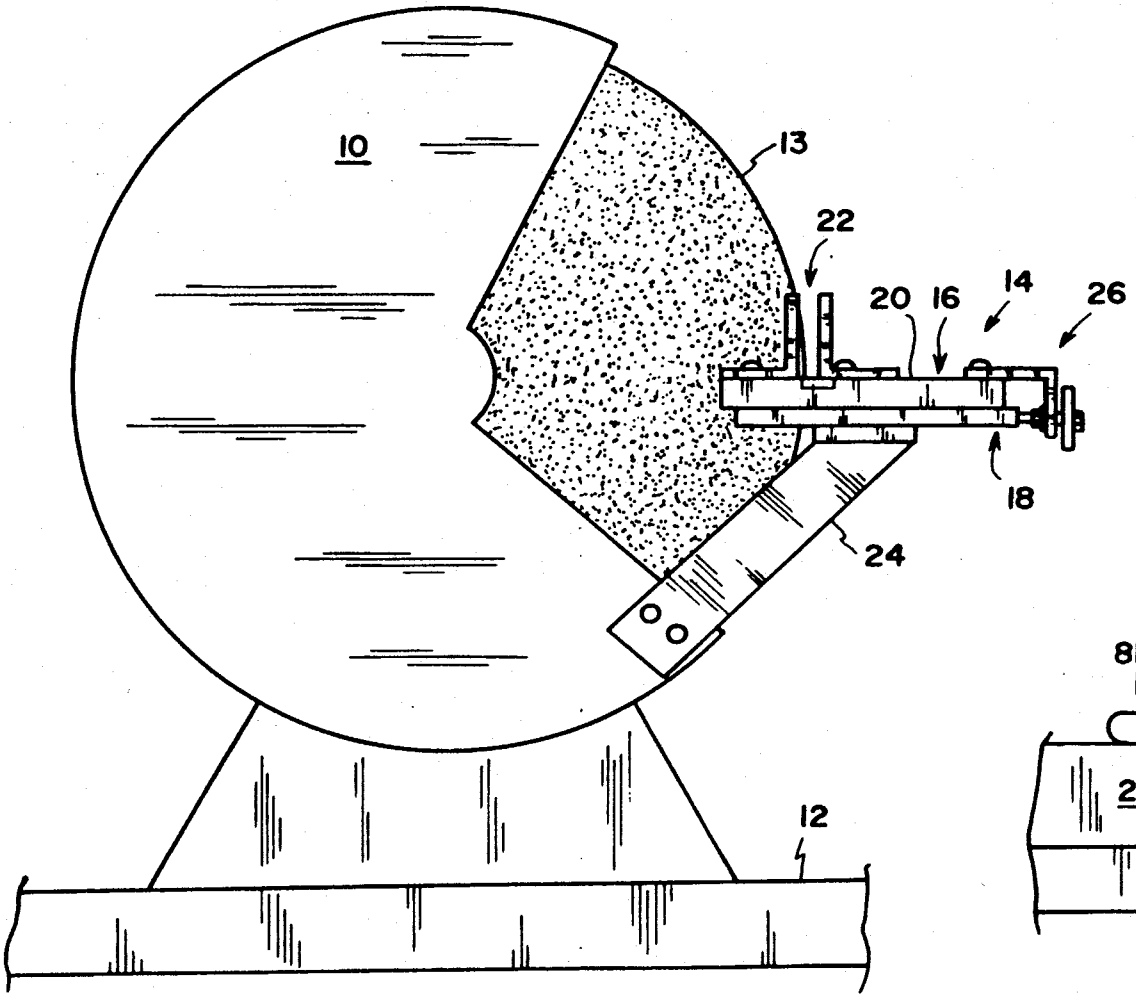
FIG. 1 is an elevational view of a bench grinder having the fixture of the present invention attached thereto.

As seen in FIG. 1, a bench grinder 10 is shown mounted to a support 12. The grinder is shown to include a rotatable grinding wheel 13 for engagement with a workpiece such as a knife blank, etc., to perform a hollow grinding operation thereon. A fixture 14 is secured to grinder 10 for maintaining the workpiece against the wheel during the grinding operation. The fixture 14 includes a top plate 16 slidably mounted on a bottom plate 18. The top plate has secured on the upper surface 20 thereof a workpiece holding assembly 22 for holding or supporting the workpiece against grinding wheel 13. The bottom plate 18 is provided with an angle bracket 24 secured thereto. Bracket 24 secures the fixture to the grinding device 10. An adjusting mechanism assembly 26 is secured to the upper and lower bodies to provide relative sliding movement therebetween.

Figure 4:
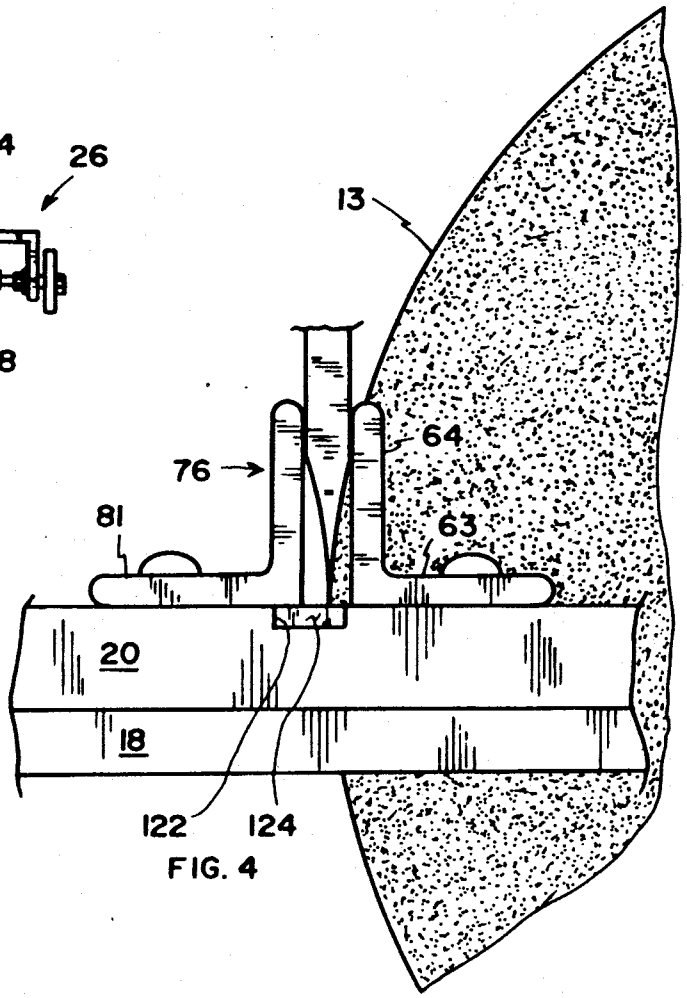
FIG. 4 is a diagrammatic end view of the positioning of a knife blank relative to the grinding wheel.
Figure 3:
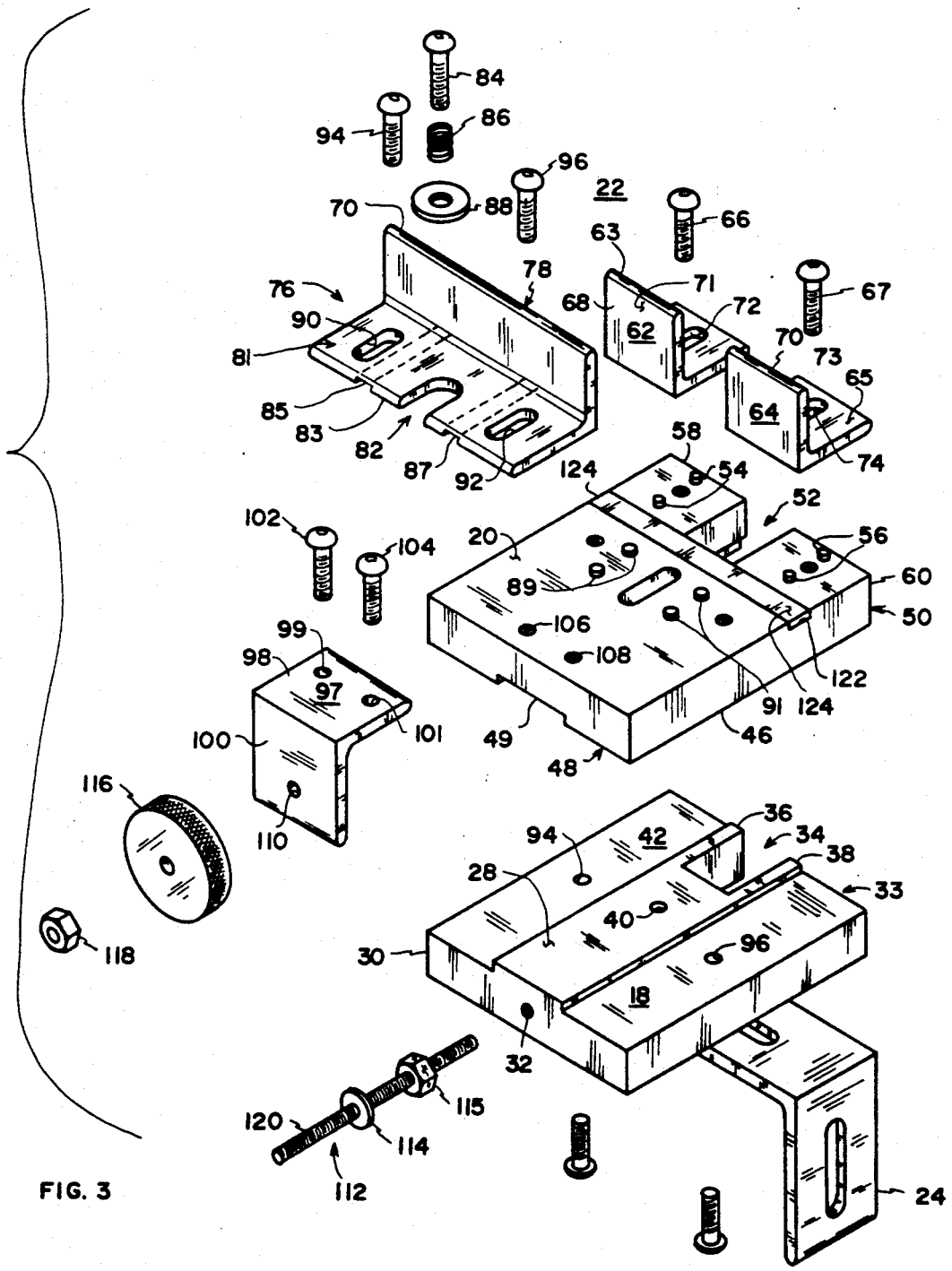
FIG. 3 is an exploded view of the hollow grinding fixture of FIG. 2.

As can be seen in FIG. 3 (which is an exploded view of the fixture), bottom plate 18 is substantially rectangular in configuration with a central raised guide 28 extending along the length thereof. The front portion 30 of plate 18 is provided with a tapped opening 32 therein for reasons explained hereinbelow. The aft portion 33 of plate 18 is provided with a cut-away section 34 to provide an opening to receive the wheel 12 of grinder 10. The cut-away section 34 removes part of the raised guide 28, leaving two edge portions 36 and 38 (FIG. 4). A tapped opening 40 is provided on the upper surface 42 of plate 18 for reasons explained hereinbelow.

Figure 2:
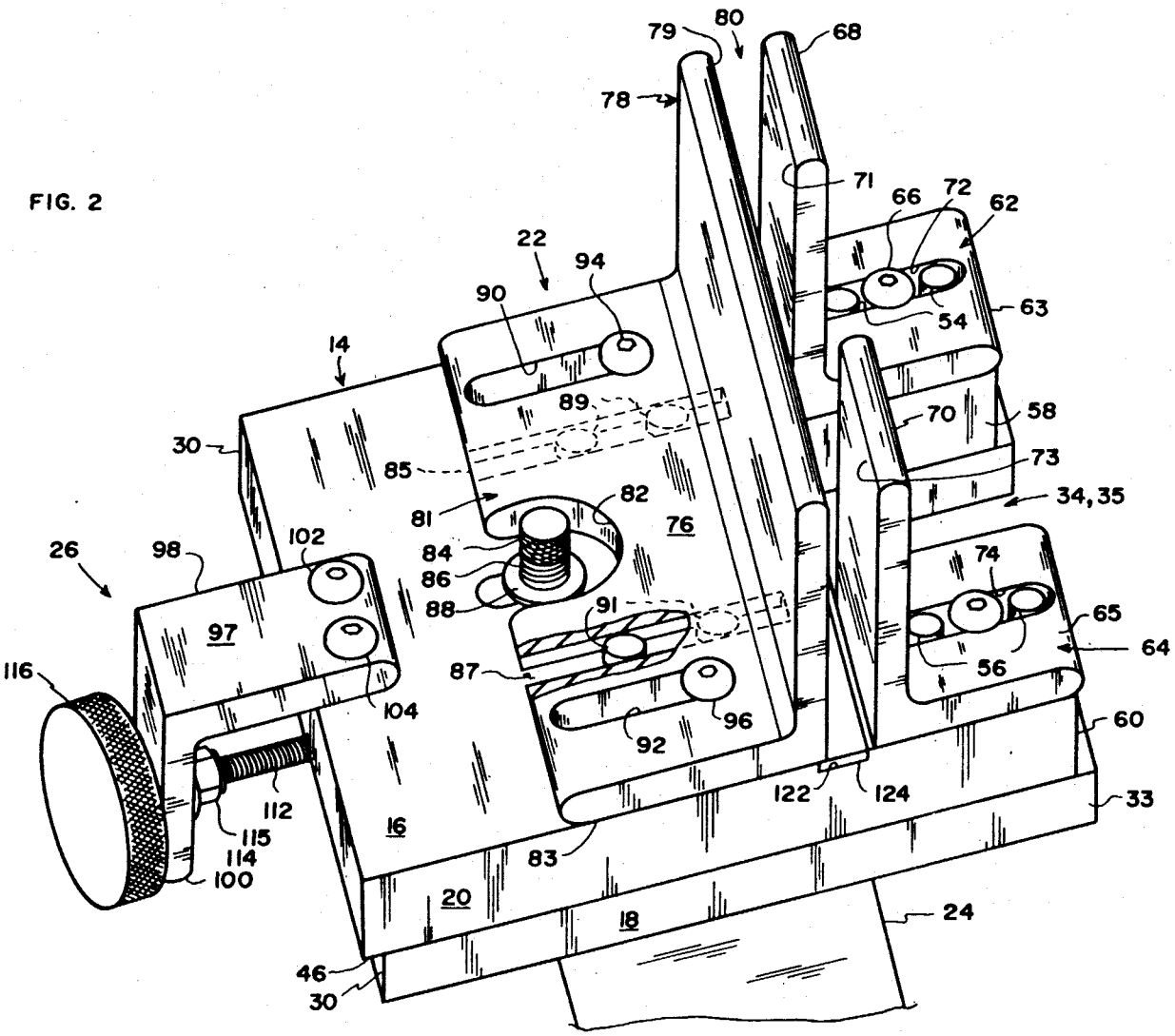
FIG. 2 is a pictorial view of the hollow grinding fixture of the present invention.

Upper plate 16 is also substantially rectangular in configuration and includes upper and lower surfaces 20 and 46 and forward and aft portions 48 and 50, respectively. Lower surface 46 is provided with a grooved central surface 49 extending the length of plate 16. Groove 49 is disposed to snugly fit on the raised central guide 28 of plate 18 (FIGS. 2 and 3). The aft portion 50 of plate 16 is provided with a cut-away section 52, similar to the cut-away section 34 of plate 18, to provide an opening to receive wheel 12 of the grinder.

Upper surface 20 of plate 16 includes a slot 53 substantially in the center thereof and two pairs of dowels 54 and 56, each pair disposed on the spaced legs 58 and 60 formed by cut-away section 52. Workpiece holding assembly 22 (FIG. 2) is mounted to the upper surface 20 of plate 16. Workpiece holding assembly 22 includes a pair of spaced similar L-shaped members 62 and 64, respectively, mounted inspaced, end to end relation on spaced legs 58 and 60 of plate 20 by screws 66 and 67. L-shaped members 62 and 64 include upstanding portions 68 and 70 having respective rear surfaces 71 and 73. The two L-shaped members include horizontal legs 63 and 65 which are provided with elongated slots 72 and 74 into which the pairs of dowels 54 and 56, respectively, seat. A third elongated L-shaped member 76 extends transversely across surface 20 and includes an upstanding portion 78 having a rear surface 79. L-shaped member 76 is disposed in spaced relation with upstanding portions 68 and 70 of L-shaped members 62 and 64 to provide a space 80 therebetween to receive the workpiece therein. L-shaped member 76 further includes a horizontally extending leg 81 having an open ended slot 82 into which a shoulder bolt 84 is inserted. Bolt 84 extends through slot 53 of upper plate 20 and is disposed in threaded relation with tapped opening 40

(FIG. 3) of lower plate 18. Bolt 84 extends through a spring 86 and washer 88 for spring biasing upper plate 16 to lower plate 18. The elongated L-shaped member 76 is provided with spaced grooves 90 and 92 and is secured to plate 16 by screws 94 and 96 which respectively extend through slots 90 and 92 and into tapped openings 94 and 96 (FIG. 3) of plate 16. The underside surface 83 of horizontal leg 81 is provided with a pair of spaced grooves 85 and 87 into which the pairs of dowels 89 and 91 extend. Dowel pairs 54 and 56, associated with L-shaped members 62 and 64, and dowel pairs 89 and 91, associated with elongated L-shaped member 76, serve to maintain alignment of members 63, 64, and 76 so that the respective rear surfaces 71, 73, and 79 are disposed in substantially parallel relation.

To provide for relative sliding movement between the upper and lower plates, adjusting mechanism 26 is provided, and it includes an inverted L-shaped bracket 97 having a horizontally extending leg 98 and a downwardly depending leg 100. Leg 98 is secured to upper surface 20 of upper plate 16 by screws 102 and 104 which extend through openings 99 and 101 of bracket 97 and into tapped openings 106 and 108 (FIG. 3) of plate 16. Downwardly depending leg 100 is provided with an opening 110 (FIG. 3) through which a threaded rod 112 extends. Rod 112 extends into threaded engagement with tapped opening 32 of lower plate 18 (FIG. 3). A beveled nylon washer 114 is mounted on rod 112 intermediate a lock nut 115 and downwardly depending leg 100. A knurled knob 116 is secured on rod 112.

As can be seen in FIGS. 2, 3, and 4, upper surface 20 includes a transverse slot 122 extending in the space 80 between the L-shaped members. A carbide wear plate 124 (FIG. 2) is secured (by press fitting, etc.) in slot 122 and is disposed to engage the edge of the workpiece during the grinding operation. The wear plate may be replaced should it ever become worn.

FIG. 4 is a diagrammatic end view of the positioning of a knife blank relative to the grinding wheel, the L-shaped members 62, 64, and 76, and the wear plate 124. In operation, and as can be seen in FIG. 4, wheel 13 extends into the openings 34 and 52 at ends 58 and 60 of plates 18 and 20 for engagement with the edge of the knife blank. The blank is held firmly between members 62, 64, and 76 but is manually movable between the rear surfaces 71, 73, and 79 of the upstanding L-shaped members 68, 70, and 78.

It is to be understood that although the hollow grinding fixture of the present invention is discussed and shown herein as being used with a bench grinder, this is not to be taken in a limiting sense, as the fixture may also be used with other grinders, including square wheel belt grinders, drum sanders, and other types of belt grinders.

It is to be also understood that the bracket shown herein includes slots which provide for mounting the brackets to various types of grinding machines. While the bracket shown herein is provided with an L-shaped configuration, other types of brackets may be resorted it. The fixture of the present invention is preferably made of brass and steel, the lower plate being typically made of brass. Such materials prevent galling of the parts.

I claim:

1. A fixture assembly for retaining a workpiece, such as the edge of a knife, against a grinding device having a grinding element for performing a hollow grinding operation of said edge comprising:

means for supporting said fixture assembly in fixed relation to said grinding device;

an upper and lower plate mounted for relative movement therebetween;

workpiece supporting means mounted on said first of said plates for movement therewith toward and away from said grinding element;

spring-biased securing means for securing said plates together;

manual adjusting means interconnected between said plates for imparting said relative movement thereto, whereby said workpiece supporting means is disposed for retention of said edge against said grinding element during the grinding operation;

said upper plate being provided with an upper surface having said workpiece supporting means secured thereto and a lower surface having a first guide means disposed thereon;

said lower plate including upper and lower surfaces, said upper surface of said lower plate having a second said guide means disposed thereon for coaction with said first said guide means of said upper plate; and said workpiece supporting means including a first upstanding support plate secured to said upper plate and second and third upstanding support plates secured in spaced, end-to-end relation on said upper plate, said first support plate being disposed in spaced relation with said second and third support plates to provide a workpiece receiving space therebetween.

2. A fixture assembly for holding a workpiece, such as a knife blade member against a grinding element during a grinding operation on the edge of said workpiece, said fixture comprising:

first and second plates mounted in adjacent relation and disposed for slidable, relative movement therebetween;

means for securing said first and second plates together in said adjacent relation;

means for supporting said second plate for fixed relation between said second plate and said grinding element;

workpiece supporting means mounted on said first plate for movement therewith toward and away from said grinding element, said workpiece supporting means including workpiece guide means for receiving, retaining, and defining a guide wherein said workpiece may be reciprocally moved against said grinding element during the grinding operation, said workpiece supporting means including a first upstanding support plate mounted on said upper plate and second and third upstanding support plates mounted in spaced, end-to-end relation on said upper plate, said first upstanding support plate being disposed in spaced relation with said second and third upstanding support plates to define said workpiece guide means; and means for imparting movement to said first plate for movement of said workpiece toward and away from said grinding element.

3. A fixture as set forth in claim 2 wherein said means for securing said first and second plates together is a spring-biased securing means for spring biasing said first plate against said second plate to enhance the slidable movement therebetween.

4. A fixture assembly as set forth in claim 3 wherein said first plate is provided an elongated opening therein, and said second plate is provided with a tapped opening therein in aligned relation with said elongated opening, and said spring-biased securing means includes a screw having a threaded shaft and a head, said threaded shaft having an end portion in threaded relation with said tapped opening, and a spring carried on said shaft between said first plate and said head of said screw.

5. A fixture as set forth in claim 2 wherein said first and second plates are provided with upper and lower surfaces and include an aft portion having a groove therein, said groove being disposed adjacent to and aligned with the space between said spaced second and third upstanding members, whereby said grinding element may extend beyond the aft peripheral edges of said first and second plates to engage said workpiece.

6. A fixture as set forth in claim 5 wherein said means for imparting movement to said first plate includes manually adjusting means, said adjusting means including a first bracket secured to said first plate, said first bracket having a downwardly depending arm having an opening therethrough, a threaded shaft having a first end extending in threaded relation in a threaded opening in said second plate and a second end attached to and extending through said opening of said downwardly depending arm, and means secured to said threaded rod for engaging said first bracket while rotating said threaded rod into threaded engagement with said second plate, whereby said first plate is disposed for slidable movement on said second plate.

7. A fixture as set forth in claim 6 wherein said means for supporting said lower plate is a second bracket secured to said second plate.

8. A fixture as set forth in claim 7 wherein said first and second plates include first and second guide means, respectively, for guiding said plates during said relative movement thereof, said first guide means being a groove disposed on said lower surface of said first plate.

9. A fixture as set forth in claim 8 wherein said second guide means is a raised surface disposed on said upper surface of said second plate, said raised surface disposed for insertion into said first guide means for coaction therebetween for guiding said plates during said relative movement.

10. A fixture as set forth in claim 9 wherein said first, second, and third upstanding support plates are L-shaped members, each including an upstanding back portion and a horizontally extending leg portion provided with a slotted opening therein, said first, second, and third L-shaped members mounted on said upper surface of said first plate with said upstanding back portions of said second and third L-shaped members being disposed in spaced relation with said upstanding back portion of said first L-shaped member to define said workpiece guide means, and said upper surface of said second plate includes a pair of spaced dowel members for fitting into each of said slotted openings of said leg portions of said second and third L-shaped members, said dowel members being disposed for aligned relation of said second and third upstanding L-shaped members on said upper surface.

11. A fixture as set forth in claim 10 wherein said first L-shaped member is provided with guide means for aligned substantially parallel relation with said second and third L-shaped members.

12. A fixture as set forth in claim 11 wherein said horizontal leg of said first L-shaped member includes an underside surface provided with spaced grooves thereacross, said guide means of said first L-shaped member being defined by two pairs of spaced dowel members provided on said upper surface of said upper plate, one pair of dowel members extending into a first of said spaced grooves, the second pair of said dowel members extending into the second of said pair of grooves, said grooves and said dowel members defining said guide means of said first L-shaped member.

* * * * *